US007960322B2

(12) United States Patent
Boffa

(10) Patent No.: US 7,960,322 B2
(45) Date of Patent: Jun. 14, 2011

(54) LUBRICATING OIL COMPOSITIONS COMPRISING A BIODIESEL FUEL AND AN ANTIOXIDANT

(75) Inventor: Alexander B. Boffa, Oakland, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 100 days.

(21) Appl. No.: 11/925,289

(22) Filed: Oct. 26, 2007

(65) Prior Publication Data

US 2009/0111720 A1 Apr. 30, 2009

(51) Int. Cl.
*C10M 137/10* (2006.01)
*C10L 1/18* (2006.01)

(52) U.S. Cl. ..... 508/371; 44/385

(58) Field of Classification Search ..... 508/371; 44/371, 301, 385

See application file for complete search history.

(56) References Cited

U.S. PATENT DOCUMENTS

| | | | | |
|---|---|---|---|---|
| 5,102,566 | A | 4/1992 | Fetterman et al. | |
| 5,320,765 | A * | 6/1994 | Fetterman et al. | 508/192 |
| 5,326,485 | A | 7/1994 | Cervenka et al. | |
| 5,567,342 | A | 10/1996 | Inoue et al. | |
| 5,578,090 | A * | 11/1996 | Bradin | 44/308 |
| 5,925,600 | A | 7/1999 | Atherton | |
| 5,994,277 | A | 11/1999 | Ritchie et al. | |
| 6,569,818 | B2 | 5/2003 | Nakazato et al. | |
| 6,887,283 | B1 * | 5/2005 | Ginosar et al. | 44/388 |
| 2003/0216266 | A1 | 11/2003 | Hirano et al. | |
| 2005/0107269 | A1 | 5/2005 | Yagishita et al. | |
| 2006/0281642 | A1 | 12/2006 | Colbourne et al. | |

FOREIGN PATENT DOCUMENTS

| | | | |
|---|---|---|---|
| EP | 1167497 | A | 1/2009 |
| WO | WO 2009/013275 | A | 1/2009 |
| WO | WO 2009/050984 | A | 4/2009 |
| WO | WO 2009/054322 | A | 4/2009 |

OTHER PUBLICATIONS

European search report, dated Nov. 26, 2009.

S. Marsch, M. Corrad I, "The effect of biodiesel on engine lubricants", Lubes'N'Greases Magazine, [Online] Jun. 2007, pp. 28-34, vol. 13, No. 6, USA.

* cited by examiner

*Primary Examiner* — Walter D Griffin
*Assistant Examiner* — Frank C Campanell
(74) *Attorney, Agent, or Firm* — Jones Day

(57) ABSTRACT

This invention encompasses a lubricating oil composition contaminated with at least about 0.3 wt % of a biodiesel fuel or a decomposition product thereof, based on the total weight of the lubricating oil composition, comprising:

a. a major amount of base oil of lubricating viscosity; and
b. a diarylamine compound, wherein, the amount of the diarylamine compound is at least about 0.1 wt. %, based on the total weight of the lubricating oil composition.

Methods of using the lubricating oil compositions are also described.

24 Claims, 1 Drawing Sheet

LUBRICATING OIL COMPOSITIONS COMPRISING A BIODIESEL FUEL AND AN ANTIOXIDANT

FIELD OF THE INVENTION

Provided herein are lubricating oil compositions comprising a base oil and an antioxidant, particularly a diarylamine antioxidant, wherein the composition further contains at least 0.3 wt % of a biodiesel fuel or a decomposition product thereof. Methods of making and using the lubricating oil compositions are also described.

BACKGROUND OF THE INVENTION

The contamination or dilution of lubricating engine oils in internal combustion engines such as biodiesel engines has been a concern. Biodiesel fuels comprise components of low volatility which are slow to vaporize after injecting into the cylinders of the biodiesel engine. This may result in an accumulation of these components of low volatility on the cylinder wall where they can be subsequently deposited onto the crankshaft by the action of the piston rings. Because biodiesel fuels generally have low oxidative stability, these deposits on the cylinder wall or in the crankshaft can degrade oxidatively and form polymerized and cross-linked biodiesel gums, sludges or varnish-like deposits on the metal surfaces that may damage the biodiesel engine or the crankshaft. Furthermore, biodiesel fuels and resulting partially combusted decomposition products can contaminate the engine's lubricants. These biodiesel contaminants further contribute to the formation of oxidization of the engine oil, deposit formation, and corrosion, particularly of lead and copper based bearing material. The influence of biodiesel on the engine oil may require improved additives formulations to address oxidation, corrosion, and deposits within the engine.

Generally the gums, sludges or deposits can be minimized by using a lubricating oil composition. However, lubricating oil compositions generally comprise a base oil which can also be oxidized under the extreme conditions while lubricating the running parts of an internal combustion engine. Therefore, there is always a need to protect the base oils from oxidative deterioration. Further, there is also a need to protect the biodiesel fuel from oxidation.

SUMMARY OF THE INVENTION

Provided herein are lubricating oil compositions that are oxidatively stable. In one aspect, the present invention is directed to a lubricating oil composition contaminated with at least about 0.3 wt % of a biodiesel fuel or a decomposition product thereof, based on the total weight of the lubricating oil composition, comprising:

(a) a major amount of base oil of lubricating viscosity; and (b) a diarylamine compound, wherein, the amount of the diarylamine compound is at least about 0.1 wt. %, based on the total weight of the lubricating oil composition.

In some embodiments, the base oil is present in a major amount.

Also provided herein are methods of lubricating an engine with a lubricating oil composition that is oxidatively stable. In one aspect, the methods comprise a method of lubricating a diesel engine fueled at least in part with a biodiesel fuel which comprises operating the engine with a lubricating oil composition contaminated with at least about 0.3 wt % of a biodiesel fuel or a decomposition product thereof, based on the total weight of the lubricating oil composition, wherein the lubricating oil composition comprises:

(a) a major amount of base oil of lubricating viscosity; and (b) a diarylamine compound, wherein, the amount of the diarylamine compound is at least about 0.1 wt. %, based on the total weight of the lubricating oil composition.

In some embodiments, the lubricating oil composition disclosed herein is substantially free of a vegetable oil or animal oil. In other embodiments, the lubricating oil composition disclosed herein is free of a vegetable oil or animal oil.

In certain embodiments, the lubricating oil composition disclosed herein further comprises at least one additive selected from the group consisting of antioxidants, antiwear agents, detergents, rust inhibitors, demulsifiers, friction modifiers, multi-functional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations thereof. In other embodiments, the at least one additive is at least one antiwear agent. In further embodiments, the at least one antiwear agent comprises a zinc dialkyl dithiophosphate compound. In still further embodiments, the phosphorous content derived from the zinc dialkyldithiophosphate compound is from about 0.001 wt. % to about 0.5 wt. % or from about 0.01 wt. % to about 0.12 wt. %, based on the total weight of the lubricating oil composition.

In some embodiments, the sulfated ash content of the lubricating oil composition disclosed herein is at most about 1.0 wt. %, based on the total weight of the lubricating oil composition.

In certain embodiments, the biodiesel fuel of the lubricating oil composition disclosed herein comprises an alkyl ester of a long chain fatty acid. In further embodiments, the long chain fatty acid comprises from about 12 carbon atoms to about 30 carbon atoms. In certain embodiments, the amount of the biodiesel fuel is from about 1 wt. % to about 20 wt. %, based on the total weight of the lubricating oil composition.

In some embodiments, the amount of the base oil of the lubricating oil composition disclosed herein is at least 40 wt. %, based on the total weight of the lubricating oil composition. In further embodiments, the base oil has a kinematic viscosity from about 5 cSt to about 20 cSt at 100° C.

In some embodiments, the amount of the diarylamine compound of the lubricating oil composition disclosed herein is at least about 0.4 wt. %, based on the total weight of the lubricating oil composition. In other embodiments, the diarylamine compound is a diphenylamine compound. In further embodiments, the diphenylamine compound is an alkylated diphenylamine compound. In still further embodiments, the alkylated diphenylamine comprises a $C_{1-20}$ alkyl group. In still further embodiments, the alkylated diphenylamine is bis-nonylated diphenylamine, bis-octylated diphenylamine, octylated/butylated diphenylamine, or a combination thereof.

Other embodiments will be in part apparent and in part pointed out hereinafter.

DEFINITIONS

Figure 1:
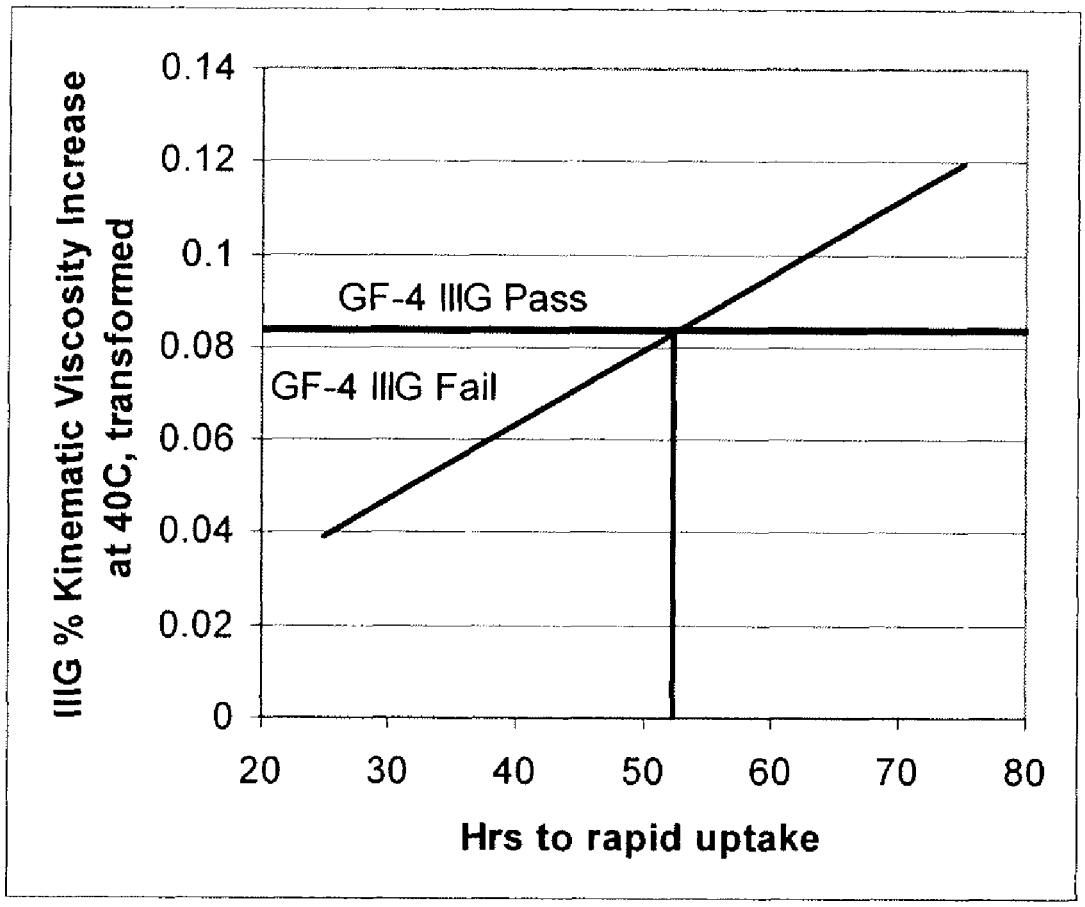
FIG. 1 is a plot of the regression between IIIG kinematic viscosity increase measured at 40 degrees C. (ASTM D445) relative to fresh oil after 100 hours operation in the Sequence IIIG engine test versus the bulk oxidation test hours to rapid uptake based on 22 oils.

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

"Biofuel" refers to a fuel (e.g., methane) that is produced from renewable biological resources. The renewable biological resources include recently living organisms and their metabolic byproducts (e.g., feces from cows), plants, or biodegradable outputs from industry, agriculture, forestry and households. Examples of biodegradable outputs include straw, timber, manure, rice husks, sewage, biodegradable waste, food leftovers, wood, wood waste, wood liquors, peat, railroad ties, wood sludge, spent sulfite liquors, agricultural waste, straw, tires, fish oils, tall oil, sludge waste, waste alcohol, municipal solid waste, landfill gases, other waste, and ethanol blended into motor gasoline. Plants that can be used to produce biofuels include corn, soybeans, flaxseed, rapeseed, sugar cane, palm oil and jatropha. Examples of biofuel include alcohol derived from fermented sugar and biodiesel derived from vegetable oil or wood.

"Biodiesel fuel" refers to an alkyl ester made from esterification or transesterification of natural oils for use to power diesel engines. In some embodiments, the biodiesel fuel is produced by esterifying a natural oil with an alcohol (e.g., ethanol or methanol) in the presence of a catalyst to form an alkyl ester. In other embodiments, the biodiesel fuel comprises at least one alkyl ester of a long chain fatty acid derived from a natural oil such as vegetable oils or animal fats. In further embodiments, the long chain fatty acid contains from about 8 carbon atoms to about 40 carbon atoms, from about 12 carbon atoms to about 30 carbon atoms, or from about 14 carbon atoms to about 24 carbon atoms. In certain embodiments, the biodiesel fuel disclosed herein is used to power conventional diesel-engines designed to be powered by petroleum diesel fuels. The biodiesel fuel generally is biodegradable and non-toxic, and typically produces about 60% less net carbon dioxide emissions than petroleum-based diesel.

"Petrodiesel fuel" refers to a diesel fuel produced from petroleum.

"A major amount" of a base oil refers to the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition.

"Sulfated ash content" refers to the amount of metal-containing additives (e.g., calcium, magnesium, molybdenum, zinc, etc.) in a lubricating oil and is typically measured according to ASTM D874, which is incorporated herein by reference.

A composition that is "substantially free" of a compound refers to a composition which contains less than 20 wt. %, less than 10 wt. %, less than 5 wt. %, less than 4 wt. %, less than 3 wt. %, less than 2 wt. %, less than 1 wt. %, less than 0.5 wt. %, less than 0.1 wt. %, or less than 0.01 wt. % of the compound, based on the total weight of the composition.

A composition that is "free" of a compound refers to a composition which contains from 0.001 wt. % to 0 wt. % of the compound, based on the total weight of the composition.

In the following description, all numbers disclosed herein are approximate values, regardless whether the word "about" or "approximate" is used in connection therewith. They may vary by 1 percent, 2 percent, 5 percent, or, sometimes, 10 to 20 percent. Whenever a numerical range with a lower limit, $R^L$, and an upper limit, $R^U$, is disclosed, any number falling within the range is specifically disclosed. In particular, the following numbers within the range are specifically disclosed: $R=R^L+k*(R^U-R^L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed.

DESCRIPTION OF EMBODIMENTS OF THE INVENTION

Provided herein are lubricating oil compositions contaminated with at least about 0.3 wt % of a biodiesel fuel or a decomposition product thereof, based on the total weight of the lubricating oil composition, comprising:

(a) a major amount of base oil of lubricating viscosity; and (b) a diarylamine compound, wherein, the amount of the diarylamine compound is at least about 0.1 wt. %, based on the total weight A. The Oil of Lubricating Viscosity The lubricating oil compositions disclosed herein generally comprise at least one oil of lubricating viscosity. Any base oil known to a skilled artisan can be used as the oil of lubricating viscosity disclosed herein. Some base oils suitable for preparing the lubricating oil compositions have been described in Mortier et al., "*Chemistry and Technology of Lubricants*," 2nd Edition, London, Springer, Chapters 1 and 2 (1996); and A. Sequeria, Jr., "*Lubricant Base Oil and Wax Processing*," New York, Marcel Decker, Chapter 6, (1994); and D. V. Brock, *Lubrication Engineering*, Vol. 43, pages 184-5, (1987), all of which are incorporated herein by reference. Generally, the amount of the base oil in the lubricating oil composition may be from about 70 to about 99.5 wt. %, based on the total weight of the lubricating oil composition. In some embodiments, the amount of the base oil in the lubricating oil composition is from about 75 to about 99 wt. %, from about 80 to about 98.5 wt. %, or from about 80 to about 98 wt. %, based on the total weight of the lubricating oil composition.

In certain embodiments, the base oil is or comprises any natural or synthetic lubricating base oil fraction. Some non-limiting examples of synthetic oils include oils, such as polyalphaolefins or PAOs, prepared from the polymerization of at least one alpha-olefin, such as ethylene, or from hydrocarbon synthesis procedures using carbon monoxide and hydrogen gases, such as the Fisher-Tropsch process. In certain embodiments, the base oil comprises less than about 10 wt. % of one or more heavy fractions, based on the total weight of the base oil. A heavy fraction refers to a lube oil fraction having a viscosity of at least about 20 cSt at 100° C. In certain embodiments, the heavy fraction has a viscosity of at least about 25 cSt or at least about 30 cSt at 100° C. In further embodiments, the amount of the one or more heavy fractions in the base oil is less than about 10 wt. %, less than about 5 wt. %, less than about 2.5 wt. %, less than about 1 wt. %, or less than about 0.1 wt. %, based on the total weight of the base oil. In still further embodiments, the base oil comprises no heavy fraction.

In certain embodiments, the lubricating oil compositions comprise a major amount of a base oil of lubricating viscosity. In some embodiments, the base oil has a kinematic viscosity at 100° C. from about 2.5 centistokes (cSt) to about 20 cSt, from about 4 centistokes (cSt) to about 20 cSt, or from about 5 cSt to about 16 cSt. The kinematic viscosity of the base oils or the lubricating oil compositions disclosed herein can be measured according to ASTM D 445, which is incorporated herein by reference.

In other embodiments, the base oil is or comprises a base stock or blend of base stocks. In further embodiments, the base stocks are manufactured using a variety of different processes including, but not limited to, distillation, solvent refining, hydrogen processing, oligomerization, esterification, and rerefining. In some embodiments, the base stocks comprise a rerefined stock. In further embodiments, the rerefined stock shall be substantially free from materials introduced through manufacturing, contamination, or previous use.

In some embodiments, the base oil comprises one or more of the base stocks in one or more of Groups I-V as specified in the American Petroleum Institute (API) Publication 1509, Fourteen Edition, December 1996 (i.e., API Base Oil Interchangeability Guidelines for Passenger Car Motor Oils and Diesel Engine Oils), which is incorporated herein by reference. The API guideline defines a base stock as a lubricant component that may be manufactured using a variety of different processes. Groups I, II and III base stocks are mineral oils, each with specific ranges of the amount of saturates, sulfur content and viscosity index. Group IV base stocks are polyalphaolefins (PAO). Group V base stocks include all other base stocks not included in Group I, II, III, or IV.

The saturates levels, sulfur levels and viscosity indices for Group I, II, III, IV and V base stocks are listed in Table 1 below.

TABLE 1

| Group | Saturates (As determined by ASTM D 2007) | Sulfur (As determined by ASTM D 2270) | Viscosity Index (As determined by ASTM D 4294, ASTM D 4297 or ASTM D 3120) |
|---|---|---|---|
| I | Less than 90% saturates. | Greater than or equal to 0.03% sulfur. | Greater than or equal to 80 and less than 120. |
| II | Greater than or equal to 90% saturates. | Less than or equal to 0.03% sulfur. | Greater than or equal to 80 and less than 120. |
| III | Greater than or equal to 90% saturates. | Less than or equal to 0.03% sulfur. | Greater than or equal to 120. |
| IV | Defined as polyalphaolefins (PAO) | | |
| V | All other base stocks not included in Groups I, II, III or IV | | |

In some embodiments, the base oil comprises one or more of the base stocks in Group I, II, III, IV, V or a combination thereof. In other embodiments, the base oil comprises one or more of the base stocks in Group II, III, IV or a combination thereof. In further embodiments, the base oil comprises one or more of the base stocks in Group II, III, IV or a combination thereof wherein the base oil has a kinematic viscosity from about 2.5 centistokes (cSt) to about 20 cSt, from about 4 cSt to about 20 cSt, or from about 5 cSt to about 16 cSt at 100° C.

The base oil may be selected from the group consisting of natural oils of lubricating viscosity, synthetic oils of lubricating viscosity and mixtures thereof. In some embodiments, the base oil includes base stocks obtained by isomerization of synthetic wax and slack wax, as well as hydrocrackate base stocks produced by hydrocracking (rather than solvent extracting) the aromatic and polar components of the crude. In other embodiments, the base oil of lubricating viscosity includes natural oils, such as animal oils, vegetable oils, mineral oils (e.g., liquid petroleum oils and solvent treated or acid-treated mineral oils of the paraffinic, naphthenic or mixed paraffinic-naphthenic types), oils derived from coal or shale, and combinations thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated.

In some embodiments, the synthetic oils of lubricating viscosity include hydrocarbon oils and halo-substituted hydrocarbon oils such as polymerized and inter-polymerized olefins, alkylbenzenes, polyphenyls, alkylated diphenyl ethers, alkylated diphenyl sulfides, as well as their derivatives, analogues and homologues thereof, and the like. In other embodiments, the synthetic oils include alkylene oxide polymers, interpolymers, copolymers and derivatives thereof wherein the terminal hydroxyl groups can be modified by esterification, etherification, and the like. In further embodiments, the synthetic oils include the esters of dicarboxylic acids with a variety of alcohols. In certain embodiments, the synthetic oils include esters made from $C_5$ to $C_{12}$ monocarboxylic acids and polyols and polyol ethers. In further embodiments, the synthetic oils include tri-alkyl phosphate ester oils, such as tri-n-butyl phosphate and tri-iso-butyl phosphate.

In some embodiments, the synthetic oils of lubricating viscosity include silicon-based oils (such as the polyakyl-, polyaryl-, polyalkoxy-, polyaryloxy-siloxane oils and silicate oils). In other embodiments, the synthetic oils include liquid esters of phosphorus-containing acids, polymeric tetrahydrofurans, polyalphaolefins, and the like.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

In further embodiments, the base oil comprises a poly-alpha-olefin (PAO). In general, the poly-alpha-olefins may be derived from an alpha-olefin having from about 2 to about 30, from about 4 to about 20, or from about 6 to about 16 carbon atoms. Non-limiting examples of suitable poly-alpha-olefins include those derived from octene, decene, mixtures thereof, and the like. These poly-alpha-olefins may have a viscosity from about 2 to about 15, from about 3 to about 12, or from about 4 to about 8 centistokes at 100° C. In some instances, the poly-alpha-olefins may be used together with other base oils such as mineral oils.

In further embodiments, the base oil comprises a polyalkylene glycol or a polyalkylene glycol derivative, where the terminal hydroxyl groups of the polyalkylene glycol may be modified by esterification, etherification, acetylation and the like. Non-limiting examples of suitable polyalkylene glycols include polyethylene glycol, polypropylene glycol, polyisopropylene glycol, and combinations thereof. Non-limiting examples of suitable polyalkylene glycol derivatives include ethers of polyalkylene glycols (e.g., methyl ether of polyisopropylene glycol, diphenyl ether of polyethylene glycol, diethyl ether of polypropylene glycol, etc.), mono- and polycarboxylic esters of polyalkylene glycols, and combinations thereof. In some instances, the polyalkylene glycol or polyalkylene glycol derivative may be used together with other base oils such as poly-alpha-olefins and mineral oils.

In further embodiments, the base oil comprises any of the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like). Non-limiting examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the like.

In further embodiments, the base oil comprises a hydrocarbon prepared by the Fischer-Tropsch process. The Fischer-Tropsch process prepares hydrocarbons from gases containing hydrogen and carbon monoxide using a Fischer-Tropsch catalyst. These hydrocarbons may require further processing in order to be useful as base oils. For example, the hydrocarbons may be dewaxed, hydroisomerized, and/or hydrocracked using processes known to a person of ordinary skill in the art.

In further embodiments, the base oil comprises an unrefined oil, a refined oil, a rerefined oil, or a mixture thereof. Unrefined oils are those obtained directly from a natural or synthetic source without further purification treatment. Non-limiting examples of unrefined oils include shale oils obtained directly from retorting operations, petroleum oils obtained directly from primary distillation, and ester oils obtained directly from an esterification process and used without further treatment. Refined oils are similar to the unrefined oils except the former have been further treated by one or more purification processes to improve one or more properties. Many such purification processes are known to those skilled in the art such as solvent extraction, secondary distillation, acid or base extraction, filtration, percolation, and the like. Rerefined oils are obtained by applying to refined oils processes similar to those used to obtain refined oils. Such rerefined oils are also known as reclaimed or reprocessed oils and often are additionally treated by processes directed to removal of spent additives and oil breakdown products.

B. Biodiesel Fuel

The lubricating oil compositions disclosed herein generally comprise at least one biodiesel fuel. Any biodiesel fuel which can be used to power a diesel-engine in its unaltered form can be used herein. Some non-limiting examples of biodiesel fuels are disclosed in the book by Gerhard Knothe and Jon Van Gerpen, "*The Biodiesel Handbook*," AOCS Publishing, (2005), which is incorporated herein by reference.

In some embodiments, the biodiesel fuel comprises one or more mono-alkyl esters of long chain fatty acids derived from a natural oil such as vegetable oils or animal fats. In other embodiments, the biodiesel fuel comprises one or more of methyl esters of long chain fatty acids. In further embodiments, the number of carbon atoms in the long chain fatty acids is from about 10 to about 30, from about 14 to about 26, or from about 16 to about 22. In further embodiments, the long chain fatty acid comprises palmitic acid (C16), oleic acid (C18:1), linoleic acid (C18:2) and other acids. In still further embodiments, the biodiesel fuel is derived from esterification or transesterification of corn oil, cashew oil, oat oil, lupine oil, kenaf oil, calendula oil, cotton oil, hemp oil, soybean oil, coffee oil, linseed oil, hazelnut oil, euphorbia oil, pumpkin seed oil, coriander oil, mustard seed oil, camelina oil, sesame oil, safflower oil, rice oil, tung oil, sunflower oil, cocoa oil, peanut oil, opium poppy oil, rapeseed oil, olive oil, castor bean oil, pecan nut oil, jojoba oil, jatropha oil, macadamia nut oil, Brazil nut oil, avocado oil, coconut oil, palm oil, Chinese tallow oil, or algae oil. In still further embodiments, the biodiesel fuel is chemically converted from natural oils or rapeseed, soya, jatropha or other virgin biomass, UCO (used-cooking oil), MSW (municipal solid waste) or from any viable fuel stock.

In certain embodiments, the biodiesel fuel disclosed herein comprises a biodiesel fuel that meets the EN 14214 standard, which is incorporated herein by reference. In other embodiments, the biodiesel fuels disclosed herein meet some of the EN 14214 specifications as shown in Table 2.

TABLE 2

| Property | Units | Lower Limit | Upper Limit | Test-Method |
|---|---|---|---|---|
| Ester content | % | 96.5 | — | EN 14103d |
| Density at 15° C. | $kg/m^3$ | 860 | 900 | EN ISO 3675 or EN ISO 12185. |
| Viscosity at 40° C. | $mm^2/s$ | 3.5 | 5.0 | EN ISO 3104 |
| Flash point | ° C. | >101 | — | ISO CD 3679e |
| Sulfur content | mg/kg | — | 10 | — |
| Tar remnant (at 10% distillation remnant) | % | — | 0.3 | EN ISO 10370 |
| Cetane number | — | 51.0 | — | EN ISO 5165 |
| Sulfated ash content | % | — | 0.02 | ISO 3987 |

Generally, a pure biodiesel fuel that meets the ASTM D 6751-03 specifications has a B100 designation. The ASTM D 6751-03 is incorporated herein by reference. In some embodiments, a B100 biodiesel fuel can be mixed with a petroleum diesel fuel to form a biodiesel blend which may reduce emissions and improve engine performance. The biodiesel blend may have a designation "Bxx" wherein xx refers to the amount of the B100 biodiesel in vol. %, based on the total volume of the biodiesel blend. For example, "B6" refers to a biodiesel blend which comprises 6 vol. % of the B100 biodiesel fuel and 94 vol. % of the petroleum diesel fuel.

In some embodiments, the biodiesel fuel disclosed herein is a B100, B95, B90, B85, B80, B75, B70, B65, B60, B55, B50, B45, B40, B35, B30, B25, B20, B15, B10, B8, B6, B5, B4, B3, B2 or B1 biodiesel fuel. In other embodiments, a B100 biodiesel fuel is blended with one or more mineral diesels wherein the amount of the B100 biodiesel fuel is about 5 vol. %, about 6 vol. %, about 10 vol. %, about 15 vol. %, about 20 vol. %, about 25 vol. %, about 30 vol. %, about 35 vol. %, about 40 vol. %, about 45 vol. %, about 50 vol. %, about 55 vol. %, about 60 vol. %, about 65 vol. %, about 70 vol. %, about 75 vol. %, about 80 vol. %, about 85 vol. %, about 90 vol. %, or about 95 vol. %, based on the total volume of the biodiesel blend.

In some embodiments, the biodiesel fuel is used to power conventional diesel-engines designed to be powered by petroleum diesel fuels. In other embodiments, the biodiesel fuel is used to power modified diesel engines designed to be powered by natural oils or other biofuels.

The amount of the biodiesel fuel in the lubricating oil composition can be in any amount suitable to obtain desirable properties such as biodegradability and viscosity. In some embodiments, the amount of the biodiesel fuel in the lubricating oil composition is at least about 0.3 wt %, at least about 1 wt. %, at least about 2 wt. %, at least about 3 wt. %, at least about 4 wt. %, at least about 5 wt. %, at least about 10 wt. %, at least about 15 wt. %, at least about 20 wt. %, at least about 25 wt. %, at least about 30 wt. %, at least about 35 wt. %, at least about 40 wt. %, at least about 45 wt. %, or at least about 50 wt. %, based on the total weight of the lubricating oil composition.

C. Lubricating Oil Additives

The lubricating oil compositions disclosed herein generally comprise at least one diarylamine compound. Any diarylamine compound that can reduce the tendency of the base oil to deteriorate in service can be used. Some non-limiting examples of suitable diarylamine compound include diphenylamine, phenyl-α-naphthylamine, alkylated diarylamines such as alkylated diphenylamines and alkylated phenyl-α-naphthylamines. In some embodiments, the diarylamine compound is an alkylated diphenylamine. The diarylamine compound may be used alone or in combination with other lubricating oil additives including other diarylamine compounds.

In one embodiment, the alkylated diphenylamines can be represented by formula (I):

(I)

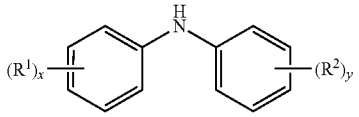

wherein each of $R^1$ and $R^2$ is independently hydrogen or an arylalkyl group having from about 7 to about 20 or from about 7 to about 10 carbons atoms; or a linear or branched alkyl group having from about 1 to about 24 carbon atoms; and each of x and y is independently 0, 1, 2, or 3, provided that at least one aromatic ring contains an arylalkyl group or a linear or branched alkyl group. In some embodiments, each of $R^1$ and $R^2$ is independently an alkyl group containing from about 4 to about 20, from about 4 to 16, from about 4 to about 12 carbon atoms, or from about 4 to about 8 carbon atoms.

In some embodiments, the alkylated diphenylamine includes, but is not limited to, bis-nonylated diphenylamine, bis-octylated diphenylamine, and octylated/butylated diphenylamine. In other embodiments, the alkylated diphenylamine comprises a first compound of formula (I) where each of $R^1$ and $R^2$ is independently octyl; and each of x and y is 1. In further embodiments, the alkylated diphenylamine comprises a second compound of formula (I) where each of $R^1$ and $R^2$ is independently butyl; and each of x and y is 1. In still further embodiments, the alkylated diphenylamine comprises a third compound of formula (I) where $R^1$ is octyl and $R^2$ is butyl; and each of x and y is 1. In still further embodiments, the alkylated diphenylamine comprises a fourth compound of formula (I) where $R^1$ is octyl; x is 2 and y is 0. In still further embodiments, the alkylated diphenylamine comprises a fifth compound of formula (I) where $R^1$ is butyl; x is 2 and y is 0. In certain embodiments, the alkylated diphenylamine comprises the first compound, second compound, third compound, fourth compound, fifth compound or a combination thereof.

In certain embodiments, the amount of the diarylamine compound, such as the alkylated diphenylamines, in the lubricating oil compositions disclosed herein is at least about 0.1 wt. %, at least about 0.2 wt. %, at least about 0.3 wt. %, at least about 0.4 wt. %, at least about 0.5 wt. %, at least about 1.0 wt. %, at least about 1.5 wt. %, at least about 2 wt. %, or at least about 5 wt. %, based on the total weight of the lubricating oil composition.

In certain embodiments, the amount of the diarylamine compound is less than about 10 wt. %.

Optionally, the lubricating oil composition may further comprise at least an additive or a modifier (hereinafter designated as "additive") that can impart or improve any desirable property of the lubricating oil composition. Any additive known to a person of ordinary skill in the art may be used in the lubricating oil compositions disclosed herein. Some suitable additives have been described in Mortier et al., "*Chemistry and Technology of Lubricants*," 2nd Edition, London, Springer, (1996); and Leslie R. Rudnick, "*Lubricant Additives: Chemistry and Applications*," New York, Marcel Dekker (2003), both of which are incorporated herein by reference. In some embodiments, the additive can be selected from the group consisting of antioxidants, antiwear agents, detergents, rust inhibitors, demulsifiers, friction modifiers, multifunctional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations thereof. In general, the concentration of each of the additives in the lubricating oil composition, when used, may range from about 0.001 wt. % to about 10 wt. %, from about 0.01 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

The lubricating oil composition disclosed herein can optionally comprise an anti-wear agent that can reduce friction and excessive wear. Any anti-wear agent known by a person of ordinary skill in the art may be used in the lubricating oil composition. Non-limiting examples of suitable anti-wear agents include zinc dithiophosphate, metal (e.g., Pb, Sb, Mo and the like) salts of dithiophosphate, metal (e.g., Zn, Pb, Sb, Mo and the like) salts of dithiocarbamate, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-wear agents have been described in Leslie R. Rudnick, "*Lubricant Additives: Chemistry and Applications*," New York, Marcel Dekker, Chapter 8, pages 223-258 (2003), which is incorporated herein by reference.

In certain embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

The amount of the dihydrocarbyl dithiophosphate metal salt including the zinc dialkyl dithiophosphate salts in the lubricating oil composition disclosed herein is measured by its phosphosphorus content. In some embodiments, the phosphosphorus content of the lubricating oil composition disclosed herein is from about 0.01 wt. % to about 0.12 wt. %, from about 0.01 wt. % to about 0.10 wt. %, or from about 0.02 wt. % to about 0.08 wt. %, based on the total weight of the lubricating oil composition.

In one embodiment, the phosphorous content of the lubricating oil composition herein is from about 0.01 to 0.08 wt % based on the total weight of the lubricating oil composition. In another embodiment, the phosphorous content of the lubricating oil composition herein is from about 0.05 to 0.12 wt % based on the total weight of the lubricating oil composition.

The dihydrocarbyl dithiophosphate metal salt may be prepared in accordance with known techniques by first forming a dihydrocarbyl dithiophosphoric acid (DDPA), usually by reacting one or more of alcohols and phenolic compounds with $P_2S_5$ and then neutralizing the formed DDPA with a compound of the metal, such as an oxide, hydroxide or carbonate of the metal. In some embodiments, a DDPA may be made by reacting mixtures of primary and secondary alcohols with $P_2S_5$. In other embodiments, two or more dihydrocarbyl dithiophosphoric acids can be prepared where the hydrocarbyl groups on one are entirely secondary in character and the hydrocarbyl groups on the others are entirely primary in character. The zinc salts can be prepare from the dihydrocarbyl dithiophosphoric acids by reacting with a zinc compound. In some embodiments, a basic or a neutral zinc compound is used. In other embodiments, an oxide, hydroxide or carbonate of zinc is used.

In some embodiments, oil soluble zinc dialkyl dithiophosphates may be produced from dialkyl dithiophosphoric acids represented by formula (II):

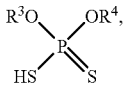

(II)

wherein each of $R^3$ and $R^4$ is independently linear or branched alkyl or linear or branched substituted alkyl. In some embodiments, the alkyl group has from about 3 to about 30 carbon atoms or from about 3 to about 8 carbon atoms.

The dialkyldithiophosphoric acids of formula (II) can be prepared by reacting alcohols $R^3OH$ and $R^4OH$ with $P_2S_5$ where $R^3$ and $R^4$ are as defined above. In some embodiments, $R^3$ and $R^4$ are the same. In other embodiments, $R^3$ and $R^4$ are different. In further embodiments, $R^3OH$ and $R^4OH$ react with $P_2S_5$ simultaneously. In still further embodiments, $R^3OH$ and $R^4OH$ react with $P_2S_5$ sequentially.

Mixtures of hydroxyl alkyl compounds may also be used. These hydroxyl alkyl compounds need not be monohydroxy alkyl compounds. In some embodiments, the dialkyldithiophosphoric acids is prepared from mono-, di-, tri-, tetra-, and other polyhydroxy alkyl compounds, or mixtures of two or more of the foregoing. In other embodiments, the zinc dialkyldithiophosphate derived from only primary alkyl alcohols is derived from a single primary alcohol. In further embodiments, that single primary alcohol is 2-ethylhexanol. In certain embodiments, the zinc dialkyldithiophosphate derived from only secondary alkyl alcohols. In further embodiments, that mixture of secondary alcohols is a mixture of 2-butanol and 4-methyl-2-pentanol.

The phosphorus pentasulfide reactant used in the dialkyldithiophosphoric acid formation step may contain certain amounts of one or more of $P_2S_3$, $P_4S_3$, $P_4S_7$, or $P_4S_9$. Compositions as such may also contain minor amounts of free sulfur. In certain embodiments, the phosphorus pentasulfide reactant is substantially free of any of $P_2S_3$, $P_4S_3$, $P_4S_7$, and $P_4S_9$. In certain embodiments, the phosphorus pentasulfide reactant is substantially free of free sulfur.

In the present invention, the sulfated ash content of the total lubricating oil composition is about 5 wt. %, about 4 wt. %, about 3 wt. %, about 2 wt. %, or about 1 wt. %, as measured according to ASTM D874.

Optionally, the lubricating oil composition disclosed herein can further comprise an additional antioxidant that can reduce or prevent the oxidation of the base oil. Any antioxidant known by a person of ordinary skill in the art may be used in the lubricating oil composition. Non-limiting examples of suitable antioxidants include amine-based antioxidants (e.g., alkyl diphenylamines, phenyl-α-naphthylamine, alkyl or aralkyl substituted phenyl-α-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof. The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable antioxidants have been described in Leslie R. Rudnick, "Lubricant Additives: Chemistry and Applications," New York, Marcel Dekker, Chapter 1, pages 1-28 (2003), which is incorporated herein by reference.

In some embodiments, the lubricating oil composition comprises at least a detergent. Any compound or a mixture of compounds that can reduce or slow the build up of engine deposits can be used as a detergent. Some non-limiting examples of suitable detergents include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Some suitable succinimide detergents are described in GB960493, EP0147240, EP0482253, EP0613938, EP0557561 and WO 98/42808, all of which are incorporated herein by reference. In some embodiments, the detergent is a polyolefin substituted succinimide such as polyisobutylene succinimide. Some non-limiting examples of commercially available detergent additives include F7661 and F7685 (available from Infineum, Linden, N.J.) and OMA 4130D (available from Octel Corporation, Manchester, UK).

Some non-limiting examples of suitable metal detergent include sulfurized or unsulfurized alkyl or alkenyl phenates, alkyl or alkenyl aromatic sulfonates, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. Other non-limiting examples of suitable metal detergents include metal sulfonates, phenates, salicylates, phosphonates, thiophosphonates and combinations thereof. The metal can be any metal suitable for making sulfonate, phenate, salicylate or phosphonate detergents. Non-limiting examples of suitable metals include alkali metals, alkaline metals and transition metals. In some embodiments, the metal is Ca, Mg, Ba, K, Na, Li or the like.

Generally, the amount of the detergent is from about 0.001 wt. % to about 5 wt. %, from about 0.05 wt. % to about 3 wt. %, or from about 0.1 wt. % to about 1 wt. %, based on the total weight of the lubricating oil composition. Some suitable detergents have been described in Mortier et al., "*Chemistry and Technology of Lubricants* ," 2nd Edition, London, Springer, Chapter 3, pages 75-85 (1996); and Leslie R. Rudnick, "*Lubricant Additives: Chemistry and Applications*," New York, Marcel Dekker, Chapter 4, pages 113-136 (2003), both of which are incorporated herein by reference.

The lubricating oil composition disclosed herein can optionally comprise a dispersant that can prevent sludge, varnish, and other deposits by keeping particles suspended in a colloidal state. Any dispersant known by a person of ordinary skill in the art may be used in the lubricating oil composition. Non-limiting examples of suitable dispersants include alkenyl succinimides, alkenyl succinimides modified with other organic compounds, alkenyl succinimides modified by post-treatment with ethylene carbonate or boric acid, succiamides, succinate esters, succinate ester-amides, pentaerythritols, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants, benzylamines, Mannich type dispersants, phosphorus-containing dispersants, and combinations thereof. The amount of the dispersant may vary from about 0.01 wt. % to about 10 wt. %, from about 0.05 wt. % to about 7 wt. %, or from about 0.1 wt. % to about 4 wt. %, based on the total weight of the lubricating oil composition. Some suitable dispersants have been described in Mortier et al., "*Chemistry and Technology of Lubricants*," 2nd Edition, London, Springer, Chapter 3, pages 86-90 (1996); and Leslie R. Rudnick, "*Lubricant Additives: Chemistry and Applications*," New York, Marcel Dekker, Chapter 5, pages 137-170 (2003), both of which are incorporated herein by reference.

The lubricating oil composition disclosed herein can optionally comprise a friction modifier that can lower the friction between moving parts. Any friction modifier known by a person of ordinary skill in the art may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments, the friction modifier is selected from the group consisting of aliphatic amines, ethoxylated aliphatic amines, aliphatic carboxylic acid amides, ethoxylated aliphatic ether amines, aliphatic carboxylic acids, glycerol esters, aliphatic carboxylic ester-amides, fatty imidazolines, fatty tertiary amines, wherein the aliphatic or fatty group contains more than about eight carbon atoms so as to render the compound suitably oil soluble. In other embodiments, the friction modifier comprises an aliphatic substituted succinimide formed by reacting an aliphatic succinic acid or anhydride with ammonia or a primary amine. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable friction modifiers have been described in Mortier et al., "*Chemistry and Technology of Lubricants* ," 2nd Edition, London, Springer, Chapter 6, pages 183-187 (1996); and Leslie R. Rudnick, "*Lubricant Additives: Chemistry and Applications*," New York, Marcel Dekker, Chapters 6 and 7, pages 171-222 (2003), both of which are incorporated herein by reference.

The lubricating oil composition disclosed herein can optionally comprise a pour point depressant that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et al., "*Chemistry and Technology of Lubricants*," 2nd Edition, London, Springer, Chapter 6, pages 187-189 (1996); and Leslie R. Rudnick, "*Lubricant Additives: Chemistry and Applications*," New York, Marcel Dekker, Chapter 11, pages 329-354 (2003), both of which are incorporated herein by reference.

The lubricating oil composition disclosed herein can optionally comprise a demulsifier that can promote oil-water separation in lubricating oil compositions that are exposed to water or steam. Any demulsifier known by a person of ordinary skill in the art may be used in the lubricating oil composition. Non-limiting examples of suitable demulsifiers include anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof. The amount of the demulsifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable demulsifiers have been described in Mortier et al., "*Chemistry and Technology of Lubricants*," 2nd Edition, London, Springer, Chapter 6, pages 190-193 (1996), which is incorporated herein by reference.

The lubricating oil composition disclosed herein can optionally comprise a foam inhibitor or an anti-foam that can break up foams in oils. Any foam inhibitor or anti-foam known by a person of ordinary skill in the art may be used in the lubricating oil composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the anti-foam comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-foams have been described in Mortier et al., "*Chemistry and Technology of Lubricants*," 2nd Edition, London, Springer, Chapter 6, pages 190-193 (1996), which is incorporated herein by reference.

The lubricating oil composition disclosed herein can optionally comprise a corrosion inhibitor that can reduce corrosion. Any corrosion inhibitor known by a person of ordinary skill in the art may be used in the lubricating oil composition. Non-limiting examples of suitable corrosion inhibitor include half esters or amides of dodecylsuccinic acid, phosphate esters, thiophosphates, alkyl imidazolines, sarcosines and combinations thereof. The amount of the corrosion inhibitor may vary from about 0.01 wt. % to about 5 wt. %, from about 0.05 wt. % to about 3 wt. %, or from about 0.1 wt. % to about 1 wt. %, based on the total weight of the lubricating oil composition. Some suitable corrosion inhibitors have been described in Mortier et al., "*Chemistry and Technology of Lubricants*," 2nd Edition, London, Springer, Chapter 6, pages 193-196 (1996), which is incorporated herein by reference.

The lubricating oil composition disclosed herein can optionally comprise an extreme pressure (EP) agent that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. The amount of the extreme pressure agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable extreme pressure agents have been described in Leslie R. Rudnick, "*Lubricant Additives: Chemistry and Applications*," New York, Marcel Dekker, Chapter 8, pages 223-258 (2003), which is incorporated herein by reference.

The lubricating oil composition disclosed herein can optionally comprise a rust inhibitor that can inhibit the corrosion of ferrous metal surfaces. Any rust inhibitor known by a person of ordinary skill in the art may be used in the lubricating oil composition. Non-limiting examples of suitable rust inhibitors include oil-soluble monocarboxylic acids (e.g., 2-ethylhexanoic acid, lauric acid, myristic acid, palmitic acid, oleic acid, linoleic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha,omega-dicarboxylic acids having a molecular weight in the range of 600 to 3000 daltons and combinations thereof. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

Other non-limiting examples of suitable rust inhibitors include nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Further non-limiting examples of suitable rust inhibitor include stearic acid and other fatty acids, dicarboxylic acids, metal soaps, fatty acid amine salts, metal salts of heavy sulfonic acid, partial carboxylic acid ester of polyhydric alcohol, and phosphoric ester.

In some embodiments, the lubricating oil composition comprises at least a multifunctional additive. Some non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine-molybdenum complex compound, and sulfur-containing molybdenum complex compound.

In certain embodiments, the lubricating oil composition comprises at least a viscosity index improver. Some non-limiting examples of suitable viscosity index improvers include polymethacrylate type polymers, ethylene-propylene copolymers, styrene-isoprene copolymers, hydrated styrene-isoprene copolymers, polyisobutylene, and dispersant type viscosity index improvers.

In some embodiments, the lubricating oil composition comprises at least a metal deactivator. Some non-limiting examples of suitable metal deactivators include disalicylidene propylenediamine, triazole derivatives, thiadiazole derivatives, and mercaptobenzimidazoles.

The additives disclosed herein may be in the form of an additive concentrate having more than one additive. The additive concentrate may comprise a suitable diluent, such as a hydrocarbon oil of suitable viscosity. Such diluent can be selected from the group consisting of natural oils (e.g., mineral oils), synthetic oils and combinations thereof. Some non-limiting examples of the mineral oils include paraffin-based oils, naphthenic-based oils, asphaltic-based oils and combinations thereof. Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. Generally, the diluent oil can have a viscosity from about 13 centistokes to about 35 centistokes at 40° C.

D. Processes of Preparing Lubricating Oil Compositions

The lubricating oil compositions disclosed herein can be prepared by any method known to a person of ordinary skill in the art for making lubricating oils. In some embodiments, the base oil can be blended or mixed with a diarylamine compound. Optionally, one or more other additives in additional to the diarylamine compound can be added. The diarylamine compound and the optional additives may be added to the base oil individually or simultaneously. In some embodiments, the diarylamine compound and the optional additives are added to the base oil individually in one or more additions and the additions may be in any order. In other embodiments, the diarylamine compound and the additives are added to the base oil simultaneously, optionally in the form of an additive concentrate. In some embodiments, the solubilizing of the diarylamine compound or any solid additives in the base oil may be assisted by heating the mixture to a temperature from about 25° C. to about 200° C., from about 50° C. to about 150° C. or from about 75° C. to about 125° C.

Any mixing or dispersing equipment known to a person of ordinary skill in the art may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., Gaulin homogenizers and Rannie homogenizers), a mill (e.g., colloid mill, ball mill and sand mill) or any other mixing or dispersing equipment known in the art.

E. Application of the Lubricating Oil Compositions

The lubricating oil composition disclosed herein may be suitable for use as motor oils (that is, engine oils or crankcase oils), in a diesel engine, particularly a diesel engine fueled and/or contaminated at least in part with a biodiesel fuel.

The lubricating oil composition of the present invention may also be used to cool hot engine parts, keep the engine free of rust and deposits, and seal the rings and valves against leakage of combustion gases. The motor oil composition may comprise a base oil, and a diarylamine compound disclosed herein. Optionally, the motor oil composition may further comprises one or more other additives in additional to the diarylamine compound. In some embodiments, the motor oil composition further comprises a pour point depressant, a detergent, a dispersant, an anti-wear, an antioxidant, a friction modifier, a rust inhibitor, or a combination thereof.

The following examples are presented to exemplify embodiments of the invention but are not intended to limit the invention to the specific embodiments set forth. Unless indicated to the contrary, all parts and percentages are by weight. All numerical values are approximate. When numerical ranges are given, it should be understood that embodiments outside the stated ranges may still fall within the scope of the invention. Specific details described in each example should not be construed as necessary features of the invention.

EXAMPLES

The following examples are intended for illustrative purposes only and do not limit in any way the scope of the present invention.

Examples 1-2 and 5, and Comparative Examples 3-4, were top-treated with 6 wt % B100 biodiesel, fuel to simulate the effects of fuel dilution in biodiesel-fueled engines. Comparative Examples 6 to 9 were top-treated with 6 wt. % conventional ultra low sulfur diesel fuel. Lubricating oil composition of Examples 1-2 and 5 and Comparative Examples 3-4 and 6-9 were adjusted by the addition of viscosity index improver to achieve a 15W40 oil (SAE viscosity grade).

Example 1

A base-line composition was prepared and used for assessing the performance of various oxidation inhibitors in the oxidator bench test. The base-line composition contained 1.1 wt. % actives of an ethylene carbonate post-treated polyisobutenyl succinimide (available from Chevron Oronite Company LLC, San Ramon, Calif.), 2.5 wt. % actives of a borated succinimide (available from Chevron Oronite Company LLC), 1.8 wt. % actives of a high molecular weight polysuccinimide (available from Chevron Oronite Company), 0.18 wt. % actives of a low overbased calcium sulfonate detergent (available from Chevron Oronite Company LLC), 0.27 wt. % actives of a borated calcium sulfonate (available from Chevron Oronite Company LLC), 0.24 wt. % actives of an overbased magnesium sulfonate (M-400T, purchased from Witco), 0.65 wt. % actives of an overbased calcium phenate detergent (available from Chevron Oronite Company LLC), 1.1 wt. % actives of a zinc dialkyldithiophosphate (available from Chevron Oronite Company LLC), 0.3% wt. % of a polyacrylate pour point depressant (purchased from Rohmax, Horsham, Calif.), 5 ppm Si of a foam inhibitor and a 6.5 wt. % non-dispersant type ethylene-propylene copolymer viscosity index improver (available from Chevron Oronite Company LLC) in a base oil which was a mixture of a hydroprocessed 600 neutral base oil (14 wt. % of Chevron Neutral Oil 600N, available from Chevron Products Company, San Ramon, Calif.) and a Group II base oil (86 wt. % of Chevron Neutral Oil 220N, available from Chevron Products Company). The baseline composition had a phosphorus content of 0.109 wt. %.

Example 2

A lubricating oil composition was prepared in accordance with the formulation of Example I except that 1 wt. % of an alkylated diphenylamine antioxidant (an octylated/butylated diphenylamine available from Ciba Specialty Chemicals as IRGANOX® L-57) was added.

Comparative Example 3

A lubricating oil composition was prepared in accordance with the formulation of Example 1 except that 1 wt. % of a hindered phenol antioxidant (a mixture of $C_7$-$C_8$ branched alkyl esters of 3-(3,5-di-tert-butyl-4-hydroxyphenyl)propionic acid available from Ciba Specialty Chemicals as IRGANOX® L-135) was added.

Comparative Example 4

A lubricating oil composition was prepared in accordance with the formulation of Example 1 except that 1 wt. %, 450 ppm Mo, of a sulfur-containing oxymolybdenum succinimide complex (available from Chevron Oronite Company LLC) was added.

Example 5

A lubricating oil composition was prepared in accordance with the formulation of Example 1 except that a combination of 0.3 wt. % of IRGANOX® L-57, 0.5 wt. % of IRGANOX® L-135 and 0.12 wt. % of a sulfur-containing oxymolybdenum succinimide complex (available from Chevron Oronite Company LLC) was added.

Comparative Example 6

A lubricating oil composition was prepared in accordance with the formulation of Example 1 except that the composition was top-treated with 6 wt. % of a conventional ultra low sulfur diesel fuel rather than 6 wt. % biodiesel.

Comparative Example 7

A lubricating oil composition was prepared in accordance with the formulation of Example 6 except that 1 wt. % of an alkylated diphenylamine antioxidant (an octylated/butylated diphenylamine available from Ciba Specialty Chemicals as IRGANOX® L-57) was added.

Comparative Example 8

A lubricating oil composition was prepared in accordance with the formulation of Example 6 except that 1 wt. % of a hindered phenol antioxidant ($C_7$-$C_9$ branched alkyl esters of 3-(3,5-di-tert-butyl-4-hydroxyphenyl)propionic acid available from Ciba Specialty Chemicals as IRGANOX® L-135) was added.

Comparative Example 9

A lubricating oil composition was prepared in accordance with the formulation of Example 6 except that 1 wt. %, 450 ppm Mo, of a sulfur-containing oxymolybdenum succinimide complex (available from Chevron Oronite Company LLC) was added.

Oxidation studies of the products of Examples 1 to 5 were carried out in a bulk oil oxidation bench test as described by E. S. Yamaguchi et al. in Tribology Transactions, Vol. 42(4), 895-901 (1999), which is incorporated herein by reference. In this test, the rate of oxygen uptake at constant pressure by a given weight of oil was monitored. The time required (induction time) for rapid oxygen uptake per 25 grams of sample was measured at 171° C. under 1.0 atmosphere of oxygen pressure. The sample was stirred at 1000 revolutions per minute. The results were reported, however, as time for rapid oxygen uptake per 100 grams of sample. The oil contained a catalyst added as oil soluble naphthenates to provide 26 ppm iron, 45 ppm copper, 512 ppm lead, 2.3 ppm manganese, and 24 ppm tin.

The bulk oxidation test is used as a screener to predict performance for the industry standard, Sequence IIIG (ASTM D7320) oxidation engine test. The Sequence IIIG must demonstrate a maximum of viscosity increase of 150% for the ILSAC GF-4 motor oil specification. FIG. 1 is a plot of the regression between IIIG kinematic viscosity increase measured at 40 degrees C. (ASTM D445) relative to fresh oil after 100 hours operation in the Sequence IIIG engine test versus the bulk oxidation test hours to rapid uptake based on 22 oils. A transformation of 1/square root of % kinematic viscosity increase at 40 degrees C. has been applied to linearize the response. FIG. 1 shows about 52 hours to rapid uptake minimum are required to provide expected performance meeting the ILSAC GF-4 limits.

A summary of the bulk oil oxidation bench test results is provided in Table 3. Example 1, which contains no supplemental antioxidant and serves a baseline formulation, demonstrated rapid $O_2$ uptake in 14.7 hours. Formulations containing either a hindered phenol antioxidant (Comparative Example 3) or a Mo/succinimide antioxidant (Comparative Example 4) showed only nominal oxidative stability over the baseline formulation. Surprisingly, the formulation containing 1 wt. % of an alkylated diphenylamine antioxidant (Example 2) demonstrated rapid $O_2$ uptake in 60.1 hours, a significantly improved oxidative stability over the baseline formulation and formulations containing either the hindered phenol or Mo/succinimide antioxidants that exhibited rapid oxygen uptake much earlier. Example 2 is the only composition demonstrating expected performance meeting the ILSAC GF-4 standard. A formulation containing a mixture of all three antioxidants (Example 5) showed improved oxidative stability over the baseline formulation and over formulations containing only either a hindered phenol or Mo/succinimide antioxidant. The improved oxidative stability of Example 5 over the baseline formulation may be due to the presence of 0.3 wt. % of the diphenylamine antioxidant as the hindered phenol and Mo/succinimide antioxidants contribute only nominal oxidative stability.

TABLE 3

| | Antioxidant | | | |
|---|---|---|---|---|
| Example | Diphenylamine (wt. %) | Hindered phenol (wt. %) | Mo-succinimide (wt. %) | Hours to Rapid $O_2$ Uptake |
| 1 | — | — | — | 14.7 |
| 2 | 1 | — | — | 60.1 |
| 3 | — | 1 | — | 17.2 |
| 4 | — | — | 1 | 21.0 |
| 5 | 0.3 | 0.5 | 0.2 | 37.5 |

A summary of the bulk oil oxidation bench test results for the lubricant compositions top-treated with 6 wt. % conventional ultra low sulfur diesel fuel is provided in Table 4. Comparative Example 6, which contains no supplemental antioxidant and serves a baseline formulation, demonstrated rapid $O_2$ uptake in 2.8 hours. Formulations containing either a hindered phenol antioxidant (Comparative Example 8) or a Mo/succinimide antioxidant (Comparative Example 9) showed only nominal oxidative stability over the baseline formulation. The formulation containing 1 wt. % of an alkylated diphenylamine antioxidant (Comparative Example 7) demonstrated rapid $O_2$ uptake in 13.1 hours, a significantly improved oxidative stability over the base-line formulation and formulations containing either the hindered phenol or Mo/succinimide antioxidants.

TABLE 4

| | Antioxidant | | | |
|---|---|---|---|---|
| Comparative Example | Diphenylamine (wt. %) | Hindered phenol (wt. %) | Mo-succinimide (wt. %) | Hours to Rapid $O_2$ Uptake |
| 6 | — | — | — | 2.8 |
| 7 | 1 | — | — | 13.1 |
| 8 | — | 1 | — | 4.1 |
| 9 | — | — | 1 | 5.3 |

What is claimed is:

1. A lubricating oil composition contaminated with at least about 0.3 wt % of a biodiesel fuel or a decomposition product thereof, based on the total weight of the lubricating oil composition, comprising:

(a) a major amount of base oil of lubricating viscosity ; and (b) a diarylamine compound, wherein the amount of the diarylamine compound is at least about 0.1 wt. %, based on the total weight of the lubricating oil composition, and wherein the biodiesel fuel comprises an alkyl ester of a long chain fatty acid.

2. The lubricating oil composition of claim 1 further comprising at least one additive selected from the group consisting of antioxidants, antiwear agents, detergents, rust inhibitors, demulsifiers, friction modifiers, multi-functional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations thereof.

3. The lubricating oil composition of claim 1 further comprising at least one antiwear agent.

4. The lubricating oil composition of claim 3, wherein the at least one antiwear agent comprises a zinc dialkyldithiophosphate compound.

5. The lubricating oil composition of claim 4, wherein the phosphorous content derived from the zinc dialkyldithiophosphate compound is from about 0.001 wt. % to about 0.5 wt. %, based on the total weight of the lubricating oil composition.

6. The lubricating oil composition of claim 5, wherein the phosphorous content derived from the zinc dialkyldithiophosphate compound is from about 0.01 wt. % to about 0.12 wt. %, based on the total weight of the lubricating oil composition.

7. The lubricating oil composition of claim 6, wherein the phosphorous content derived from the zinc dialkyldithiophosphate compound is from about 0.01 wt. % to about 0.08 wt. %, based on the total weight of the lubricating oil composition.

8. The lubricating oil composition of claim 6, wherein the phosphorous content derived from the zinc dialkyldithiophosphate compound is from about 0.05 wt. % to about 0.12 wt. %, based on the total weight of the lubricating oil composition.

9. The lubricating oil composition of claim 1, wherein the sulfated ash content of the lubricating oil composition is at most about 2.0 wt. %, based on the total weight of the lubricating oil composition.

10. The lubricating oil composition of claim 1, wherein the long chain fatty acid comprises from about 12 carbon atoms to about 30 carbon atoms.

11. The lubricating oil composition of claim 1, wherein the amount of the biodiesel fuel or decomposition products thereof is present in the lubricating oil composition at from about 0.3 wt. % to about 20 wt. %, based on the total weight of the lubricating oil composition.

12. The lubricating oil composition of claim 1, wherein the base oil has a kinematic viscosity from about 4 cSt to about 20 cSt at 100° C.

13. The lubricating oil composition of claim 1, wherein the amount of the diarylamine compound is at least about 0.4 wt. %, based on the total weight of the lubricating oil composition.

14. The lubricating oil composition of claim 1, wherein the diarylamine compound is a diphenylamine compound.

15. The lubricating oil composition of claim 14, wherein the diphenylamine compound is an alkylated diphenylamine compound.

16. The lubricating oil composition of claim 15, wherein the alkylated diphenylamine comprises a $C_{1-20}$ alkyl group.

17. The lubricating oil composition of claim 16, wherein the alkylated diphenylamine is bis-nonylated diphenylamine, bis-octylated diphenylamine, octylated/butylated diphenylamine, or a combination thereof.

18. A method of lubricating a diesel engine fueled at least in part with a biodiesel fuel which comprises operating the engine with a lubricating oil composition contaminated with at least about 0.3 wt % of a biodiesel fuel or decomposition products thereof, based on the total weight of the lubricating oil composition, wherein the lubricating oil composition comprises:

(a) a major amount of base oil of lubricating viscosity; and (b) a diarylamine compound, wherein the amount of the diarylamine compound is at least about 0.1 wt. %, based on the total weight of the lubricating oil composition, and wherein the biodiesel fuel comprises an alkyl ester of a long chain fatty acid.

19. The method of claim 18 further comprising at least one antiwear agent.

20. The method of claim 19, wherein the at least one antiwear agent comprises a zinc dialkyldithiophosphate compound.

21. The method of claim 18, wherein the phosphorous content derived from the zinc dialkyldithiophosphate compound is from about 0.001 wt. % to about 0.5 wt. %, based on the total weight of the lubricating oil composition.

22. The method of claim 18, wherein the diarylamine compound is a diphenylamine compound.

23. The method of claim 22, wherein the diphenylamine compound is an alkylated diphenylamine compound.

24. The method of claim 23, wherein the alkylated diphenylamine comprises a $C_{1-20}$ alkyl group.

* * * * *